United States Patent [19]

Hirahama et al.

[11] 3,955,484

[45] May 11, 1976

[54] MOVABLE DUST COLLECTING DUCT

[75] Inventors: Keijiro Hirahama; Fumio Ogawara; Katsumi Matsuzaki, all of Fukuyama, Japan

[73] Assignee: Nippon Kokan Kabushiki Kaisha, Tokyo, Japan

[22] Filed: May 1, 1975

[21] Appl. No.: 573,556

[30] Foreign Application Priority Data

June 5, 1974 Japan ..... 49-62796

[52] U.S. Cl. ..... 98/115 VM; 137/251; 137/580; 202/263; 277/135

[51] Int. Cl.[2] ..... F23J 11/00

[58] Field of Search ..... 98/115 R, 115 VM; 137/580, 251, 4; 202/263; 277/135

[56] References Cited

UNITED STATES PATENTS

| | | | |
|---|---|---|---|
| 2,970,351 | 2/1961 | Rice | 98/115 VM |
| 3,380,371 | 4/1968 | Scheel | 98/115 VM |
| 3,548,845 | 12/1970 | Ogi et al. | 277/135 X |
| 3,913,470 | 10/1975 | Cullin | 98/115 VM |

*Primary Examiner*—William F. O'Dea
*Assistant Examiner*—Ronald C. Capossela
*Attorney, Agent, or Firm*—Flynn & Frishauf

[57] ABSTRACT

A fixed duct is formed by vertically setting a partition plate virtually in the middle of a duct with a U-shaped cross section composed of two side plates and a bottom plate in such a manner that the lower end of said partition plate is spaced from said bottom plate and by placing a canopy over the space between the upper end of one of said side plates and the upper end of said partition plate. An exhaust pipe is installed through said canopy. A sealing liquid is placed in said fixed duct in such a manner that the level of said liquid is always above the lower end of said partition plate. An S-shaped movable pipe extends from outside the upper end of the other of said side plates into said sealing liquid, further under the lower end of said partition plate, to above the level of part of said sealing liquid covered with said canopy. Said movable pipe freely moves along said fixed duct. Dust is collected at an end of said movable pipe and is sent to a dust collector through said exhaust pipe.

4 Claims, 2 Drawing Figures

MOVABLE DUST COLLECTING DUCT

FIELD OF THE INVENTION

This invention relates to a movable dust collecting duct for collecting dust from moving dust sources, and more particularly to a movable dust collecting duct for collecting dust generated when material coal is charged into a coke oven battery and product coke is discharged from the coke oven battery in the production of coke.

BACKGROUND OF THE INVENTION

In the production of coke, dust is generated in large quantities. A very large quantity of dust is generated especially when material coal is charged into a coke oven battery and product coke is discharged from the coke oven battery. Since a coke battery is a huge group of ovens comprising a large number of coking chambers and flues alternately arranged above regenerators, places where material coal is charged or product coke is discharged, i.e., dust sources frequently move over a considerably long distance. In addition, since a coke oven battery is a huge plant, it is in practice almost imppossible to collect dust by providing a gigantic hood which covers the entire coke oven battery.

Therefore, collection of dust in the production of coke has so far been effected by from time to time connecting a fixed duct provided on the coke oven battery side to movable pipes provided on a hood on the side of moving coal charging cars, coke guiding cars and coke quenching cars. More specifically, a number of dampers are provided on said fixed duct in order to cope with all the operating positions of said coal charging cars, coke guiding cars and coke quenching cars, and said movable pipes are from time to time connected to said dampers of said fixed duct situated nearest to said movable pipes manually or by other means, to suck dust from these dust sources and then to send said dust to a dust collector.

However, in the above-mentioned conventional method, connecting and disconnecting of said fixed duct to and from said movable pipes must be carried out whenever change the operation positions of said coal charging cars, coke guiding cars and coke quenching cars. Moreover, these operations are in most cases manually carried out. Besides, positioning of said movable pipes is quite difficult in the connecting operations. As mentioned above, since a large number of dampers must be provided on said fixed dampers, the dust collecting mechanism is complicated in structure and it is difficult to maintain gas tightness as well.

As mentioned above, conventional dust collecting operations in the production of coke are very complicated and troublesome, and operation efficiency is low.

SUMMARY OF THE INVENTION

Therefore, the object of this invention is to provide an improved movable dust collecting duct for collecting dust from moving dust sources that solves the above-mentioned problems of the conventional method.

The principal object of this invention is to provide an improved dust collecting duct that eliminates the necessity of connecting and disconnection a movable pipe to and from a fixed duct in response to the change in position of dust sources.

The dust collecting duct of this invention is characterized by comprising a fixed duct formed by vertically setting a partition plate substantially in the middle of a duct with a generally U-shaped cross section which is comprised of two side plates and a bottom plate in such a manner that the lower end of said partition plate is spaced from said bottom plate and by placing a canopy over the space between the upper end of one of said side plates and the upper end of said partition plate; an exhaust pipe installed through said canopy; sealing liquid placed in said fixed duct in such a manner that the level of said liquid is always above the lower end of said partition plate; and a generally S-shaped movable pipe extending from outside the upper end of the other of said side plates into said sealing liquid, and further extending under the lower end of said partition plate to above the level of part of said sealing liquid which is covered with said canopy. The movable pipe is preferably movable freely along said fixed duct.

DETAILED DESCRIPTION OF PREFERRED EMBODIMENTS

Figures 1, 2:
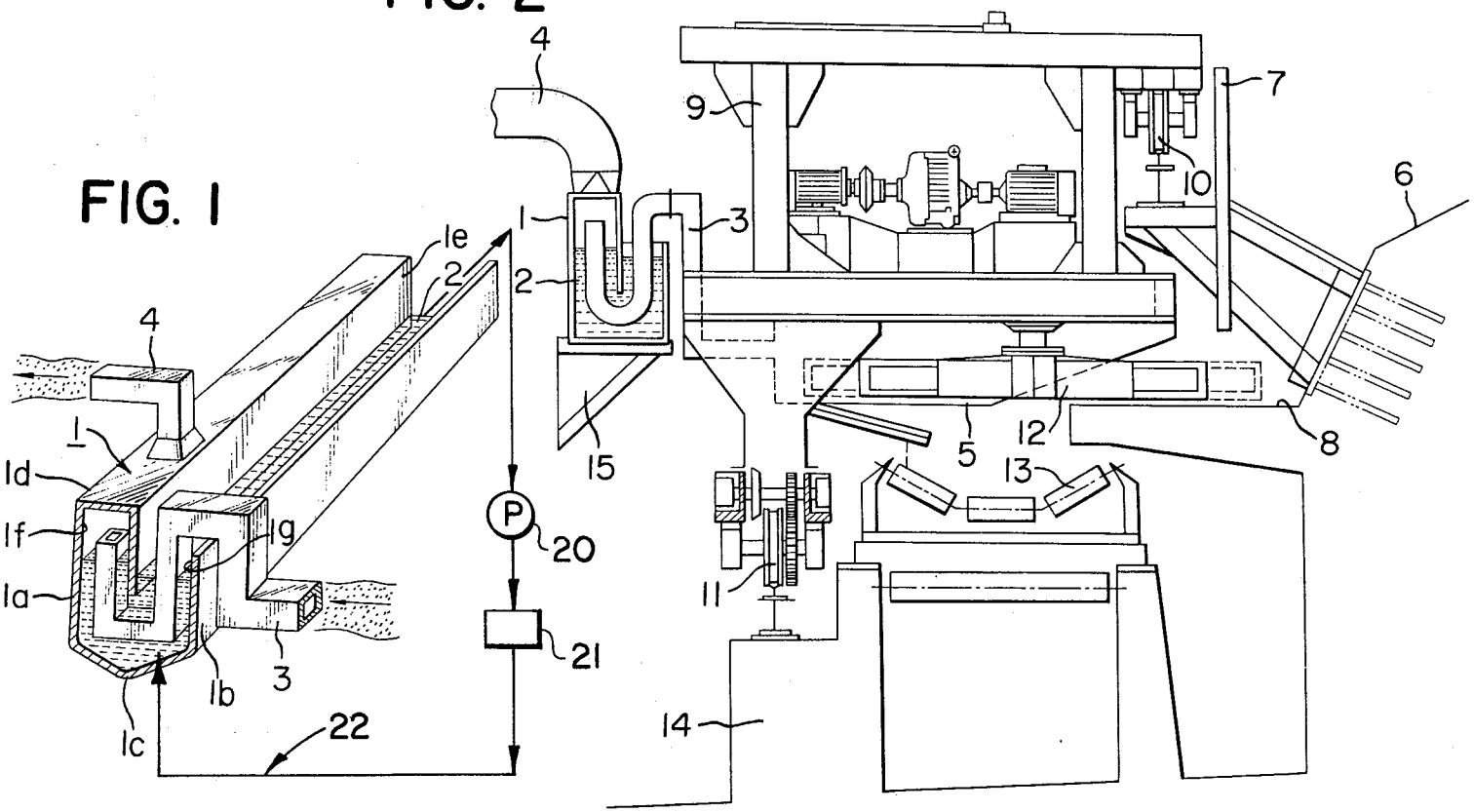
FIG. 1 is a partially cutaway perspective view which showing a movable dust collecting duct of this invention.
FIG. 2 is a schematic view of an embodiment, wherein the movable dust collecting duct of this invention is installed in a wharf loader of a coke oven battery.

The movable dust collecting duct of this invention comprises, as shown in FIG. 1, a fixed duct 1 formed by vertically setting a partition plate 1*e* virtually in the middle of a duct with a U-shaped cross section composed of two side plates 1*a* and 1*b* and a bottom plate 1*c* in such a manner that the lower end of said partition plate 1*e* is spaced from said bottom plate 1*c* and by placing a canopy 1*d* over the space between the upper end of said side plate 1*a* and the upper end of said partition plate 1*e;* an exhaust pipe 4 installed through said canopy 1*d;* sealing liquid 2 placed in said fixed duct 1 in such a manner that the level of said liquid 2 is always above the lower end of said partition plate 1e; and an S-shaped movable pipe 3 extending from outside the upper end of said side plate 1*b* into said sealing liquid 2, further under the lower end of said partition plate 1*e* to above the level of part of said sealing liquid 2 covered with said canopy 1*d*.

Said fixed duct 1 is axially divided into a gas tight portion 1*f* and an open portion 1*g* by said side plates 1*a* and 1*b*, said partition plate 1*e*, said canopy 1*d* and said sealing liquid 2. Said exhaust pipe 4 is connected to a dust collector (not shown). Said fixed duct 1 is fixed horizontally along the line of moving dust sources. As said sealing liquid, a solution suitable for treating dust or a proper liquid, e.g., water is used. Said movable pipe 3 is capable of moving freely along said fixed duct 1 in response to the movement of moving dust sources.

On starting of said dust collector (not shown), sucking force acts in a manner that dust is sucked from an end of said movable pipe 3, as indicated by the arrow, through said movable pipe 3 to said gas tight portion 1f of said fixed duct 1 and is further sent via said exhaust pipe 4, as indicated by the arrow, to said dust collector (not shown). At this moment, the level of said liquid in said gas tight portion 1f rises while the level of said liquid in said open portion 1*g* lowers, due to the difference in atmospheric pressure. Therefore, said sealing liquid 2 must be placed in said fixed duct 1 in such a sufficient quantity that the level of said sealing liquid 2 always remains above the lower end of said partition plate 1*e*, in order to always maintain the gas tightness of said gas tight portion 1*f*. When said fixed duct 1 is considerably long, it is recommended to increase the number of said exhaust pipes 4 so as to permit effective suction of dust.

Whenever a dust source moves from one place to another, said movable pipe 3 may only be moved along said fixed duct 1.

With a view to avoiding accumulation of sludge in said fixed duct 1, which may result in the prevention of smooth movement of said movable pipe 3, it is preferable that said sealing liquid 2 in said fixed duct 1 is forcedly circulated by means of a pump 20 along with sludge removal means 21 in fluid circuit 22, thus removing said sludge to outside said fixed duct 1.

FIG. 2 illustrates an outline of an embodiment of this invention, wherein the movable dust collecting duct of this invention is installed in a wharf loader of a coke oven battery. Red-hot coke discharged from the coke oven battery is quenched by water sprinkling on a coke quenching car (not shown), is caused to drop down from said coke quenching car onto a coke wharf 6, is then cut out from said coke wharf 6 to a belt conveyor 13 and is transported. The above-mentioned cutting-out of coke is carried out by a paddle 12 provided in a wharf loader 9, which scrapes off coke, sliding down from said coke wharf 6 onto an apron 8, onto said belt conveyor 13 through its slow rotation. Said coke wharf 6 has an overall length of e.g., more than 100m, and said wharf loader 9 frequently travels along said coke wharf and scrapes off coke with said paddle as mentioned above in required positions. Dust is generated in large quantities when coke is scraped off by said paddle.

As mentioned above, since said wharf loader 9 cuts out coke in various positions while frequently travelling over a considerably long distance along said coke wharf 6, it is difficult to send large quantities of dust to a dust collector (not shown) fixed in another place without leakage. In addition to this operational problem, there is a big environmental problem of air pollution. However, such problems can be easily solved by using the movable dust collecting duct of this invention.

This invention is described below in more detail with reference to FIG. 2. In the drawing, 1 designates a fixed duct, 2 designates sealing liquid, and 3 designates a movable pipe. Said fixed duct 1 is fixed on a support 15, in parallel with a coke wharf 6 and is immovable. One end of said movable pipe 3 is connected to a hood 5 attached to a wharf loader 9, and the other end thereof extends into said sealing liquid 2 and then to a gas tight portion 1*f* (FIG. 1) of said fixed duct 1. Therefore, said movable pipe 3 freely moves along said fixed duct 1 together with said wharf loader 9. In the drawing, 4 designates an exhaust pipe. One end of said exhaust pipe 4 extends to a gas tight portion 1*f* (FIG. 1) of said fixed duct 1, and the other end thereof is connected to a dust collector (not shown). Said hood 5 is installed to cover the space over places where dust is generated in large quantities, such as a paddle 12 and a belt conveyor 13, and is fixed to said wharf loader 9.

Coke caused to drop from a coke quenching car (not shown) slides down from said coke wharf 6 and accumulates on an apron 8. In the drawing, 7 designates a fence. Said fence 7 prevents coke on said coke wharf 6 from being fed excessively to said apron 8 and, at the same time, prevents said coke from scattering in all directions over said paddle 12 and said belt conveyor 13. Said wharf loader 9 is provided with upper wheels 10 and lower wheels 11 and freely travels on the rail along said coke wharf 6 by drive of a motor. As already mentioned, said movable pipe 3 moves together with said wharf loader 9. Said paddle 12 slowly rotates by drive of a motor thereby scraping off coke accumulating on said apron 8 onto said belt conveyor 13 installed on a foundation 14. Said belt conveyor 13 carries out coke scraped down thereupon.

Scraping-off of coke onto said belt conveyor 13 begins simultaneously with the start of said paddle 12. In this case, said dust collector (not shown) is started beforehand. On starting of said dust collector, the gas tight portion of said fixed duct 1 (FIG. 1) becomes under a negative pressure. In this condition, coke on said apron 8 is scraped off onto said belt conveyor 13 by the slow rotation of said paddle 12. Dust is generated in large quantities around said apron 8, said paddle 12 and said belt conveyor 13. Said dust is sucked from said hood 5, through said movable pipe 3, said gas tight portion 1f (FIG. 1) of said fixed duct 1 and said exhaust pipe 4, into said dust collector (not shown) fixed in another place. When coke accumulating in another place on said apron 8 is to be cut out, said wharf loader 9 is moved to the relevant place, and said movable pipe 3 also moves together with said wharf loader 9 along said fixed duct 1. Therefore, dust can be collected in any place without leakage and sent to said dust collector, in the same manner as mentioned above.

Application of the movable dust collecting duct of this invention is not limited to the coke oven battery. Where dust sources move and dust sources are on a definite line, the movable dust collecting duct of this invention can be employed in the same manner as in the case of the above-mentioned coke oven battery.

According to this invention as described above, complicated and troublesome operations for connecting and disconnecting the fixed duct and the movable pipe can be eliminated. Further, since hot air sucked in together with dust is cooled while passing through the sealing liquid, thermal deformation of the fixed duct can be advantageously prevented, thus producing industrially useful effects.

What is claimed is:

1. A movable dust collecting device comprising:

a fixed duct means including a duct having a length overwhich a pipe is movable, said duct having a generally U-shaped cross section, the generally U-shaped duct being comprised of two side plates and a bottom plate; a substantially vertically oriented partition plate having a length substantially cooresponding to the length of said duct and located substantially in the middle of said generally U-shaped duct, the lower end of said partition plate being spaced from said bottom plate; and a canopy mounted over the space between the upper end of one of said side plates and the upper end of said partition plate;

an exhaust pipe mounted through said canopy;

sealing liquid in said fixed duct such that the level of said sealing liquid is always above the lower end of said partition plate; and a generally S-shaped movable pipe extending from outside the upper end of the other of said side plates into said sealing liquid, further extending under the lower end of said partition plate to above the level of part of said sealing liquid which is covered with said canopy whereby said S-shaped pipe is movable longitudinally through said sealing liquid along the length of said fixed duct means.

2. The movable dust collecting device of claim 1, including means for removing sludge accumulated in said fixed duct means, said sludge removing means including means for forcedly circulating said sealing liquid in said fixed duct and through a fluid circuit, and means located in said fluid circuit for removing sludge from the sealing liquid flowing in said fluid circuit.

3. The movable dust collecting device of claim 1, wherein the portion of said fixed duct means above said sealing liquid and below said canopy is gas tight.

4. The movable dust collecting device of claim 1, wherein said sealing liquid is water.

* * * * *